US010968759B2

(12) United States Patent
Iwakiri

(10) Patent No.: US 10,968,759 B2
(45) Date of Patent: Apr. 6, 2021

(54) ROTARY MACHINE

(71) Applicant: MITSUBISHI HEAVY INDUSTRIES, LTD., Tokyo (JP)

(72) Inventor: Kenichiro Iwakiri, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 193 days.

(21) Appl. No.: 15/552,002

(22) PCT Filed: Oct. 27, 2015

(86) PCT No.: PCT/JP2015/080168
§ 371 (c)(1),
(2) Date: Aug. 18, 2017

(87) PCT Pub. No.: WO2017/072843
PCT Pub. Date: May 4, 2017

(65) Prior Publication Data

US 2018/0073375 A1 Mar. 15, 2018

(51) Int. Cl.
*F01D 7/00* (2006.01)
*F01D 5/02* (2006.01)
(Continued)

(52) U.S. Cl.
CPC ..... *F01D 7/00* (2013.01); *F01D 5/02* (2013.01); *F01D 5/025* (2013.01); *F01D 5/143* (2013.01);
(Continued)

(58) Field of Classification Search
CPC ..... F01D 7/00; F04D 29/323; F04D 29/36; F05D 2260/74
See application file for complete search history.

(56) References Cited

U.S. PATENT DOCUMENTS 3,687,569 A * 8/1972 Klompas ..... F01D 7/00 416/156
4,278,398 A * 7/1981 Hull ..... F01D 17/162 415/160
(Continued)

FOREIGN PATENT DOCUMENTS

JP 59-73600 U 5/1984
JP 3-13498 U 2/1991
(Continued)

OTHER PUBLICATIONS

English Translation of the Written Opinion of the International Searching Authority of PCT/JP2015/080168 dated Jan. 26, 2016.
International Serach Report of PCT/JP2015/080168, dated Jan. 26, 2016.
German Office Action for German Application No. 112015006776.0, dated Sep. 4, 2020.

*Primary Examiner* — Justin D Seabe
*Assistant Examiner* — Jason G Davis
(74) *Attorney, Agent, or Firm* — Birch, Stewart, Kolasch & Birch, LLP

(57) ABSTRACT

A rotary machine comprises a hub including: a blade-facing hub portion including a first blade-facing surface which faces a spherical hub-side end surface of a variable blade and which has a first spherical region having a spherical shape; an upstream hub portion disposed upstream of the blade-facing hub portion in an axial direction of the hub and having a first outer-peripheral surface being adjacent to the first blade-facing surface in the axial direction; and a downstream hub portion disposed downstream of the blade-facing hub portion in the axial direction and having a second outer peripheral surface being adjacent to the first blade-facing surface in the axial direction. At least one of following condition (a) or (b) is satisfied: (a) a downstream end of the first outer peripheral surface is disposed on an outer side of an upstream end of the first blade-facing surface in the radial direction of the hub; (b) an upstream end of the second outer peripheral surface is disposed on an outer side of a down-
(Continued)

stream end of the first blade-facing surface in the radial direction of the hub.

9 Claims, 10 Drawing Sheets

(51) Int. Cl.

| | |
|---|---|
| ***F04D 29/32*** | (2006.01) |
| ***F01D 5/14*** | (2006.01) |
| ***F01D 25/24*** | (2006.01) |
| ***F04D 29/16*** | (2006.01) |

(52) U.S. Cl.
CPC ..... *F04D 29/164* (2013.01); *F04D 29/323* (2013.01); *F01D 25/24* (2013.01); *F05D 2250/241* (2013.01)

(56) References Cited

U.S. PATENT DOCUMENTS

| | | | | |
|---|---|---|---|---|
| 4,738,586 | A * | 4/1988 | Harter | F01D 5/20 415/173.5 |
| 9,708,914 | B2 * | 7/2017 | Fulayter | F01D 17/162 |
| 2014/0056690 | A1 * | 2/2014 | Sakamoto | F01D 5/143 415/115 |
| 2016/0237845 | A1 * | 8/2016 | Teixeira | F01D 5/143 |

FOREIGN PATENT DOCUMENTS

| | | | |
|---|---|---|---|
| JP | 53-162407 | U | 2/1991 |
| JP | 7-26904 | A | 1/1995 |
| JP | 2000-356198 | A | 12/2000 |

* cited by examiner

ROTARY MACHINE

TECHNICAL FIELD

The present disclosure relates to a rotary machine.

BACKGROUND ART

In a rotary machine such as a compressor and a turbine, at least one of a stationary vane or a rotor blade may be configured as a variable blade that is revolvable about a pivot axis along the radial direction of a hub, to adjust the attack angle with respect to flow.

In a rotary machine provided with such a variable blade, if the variable blade is configured such that the hub-side end surface of the variable blade does not interfere with the blade-facing surface of the hub in the rotation range of the variable blade, clearance between the hub-side end surface of the variable blade and the blade-facing surface of the hub is likely to increase when the variable blade is revolved toward the close side (in a direction the angle between the chord line of the variable blade and the axial direction of the hub increases). If the clearance between the hub-side end surface of the variable blade and the blade-facing surface of the hub increases, loss due to a leaking flow that passes through the clearance (hereinafter, described as clearance loss) increases, and the efficiency of the rotary machine may decrease.

Patent Document 1 discloses a rotary machine with a variable blade having a spherically-shaped hub-side end surface recessed outward in the radial direction of the hub and a blade-facing surface of a hub having a spherically-shaped spherical region protruding outward in the radial direction of the hub, so that the clearance does not increase at rotation of the variable blade toward the close side.

CITATION LIST

Patent Literature

Patent Document 1: JPH3-13498U (Utility Model)

SUMMARY

Problems to be Solved

If the blade-facing surface of the hub has a spherically-shaped spherical region protruding outward in the radial direction of the hub like the rotary machine described in Patent Document 1, the spherical region protruding into a flow passage obstructs the smooth flow of fluid in the flow passage, unless some measure is provided. As a result, an outward flow in the radial direction of the hub (secondary flow) is created, and separation or the like occurs at downstream of the spherical region, which may lead to deterioration of the performance of the rotary machine.

In view of the above, an object of at least one embodiment of the present invention is to, in a rotary machine provided with a variable blade configured to be revolvable about a pivot axis along the radial direction of a hub, reduce clearance loss and suppress performance deterioration.

Solution to the Problems (1) A rotary machine according to at least one embodiment of the present invention comprises: a hub configured to be rotatable about a rotational center axis; a casing configured to cover the hub and forming a fluid flow passage between the casing and the hub;

and a variable blade disposed in the fluid flow passage and configured to be revolvable about a pivot axis along a radial direction of the hub. The variable blade includes a hub-side end surface having a spherical shape and recessed outward in the radial direction of the hub. The hub includes: a blade-facing hub portion including a first blade-facing surface which faces the hub-side end surface of the variable blade and which has a first spherical region having a spherical shape and protruding outward in the radial direction of the hub; an upstream hub portion disposed upstream of the blade-facing hub portion in an axial direction of the hub and having a first outer-peripheral surface being adjacent to the first blade-facing surface in the axial direction; and a downstream hub portion disposed downstream of the blade-facing hub portion in the axial direction and having a second outer peripheral surface being adjacent to the first blade-facing surface in the axial direction. At least one of following condition (a) or (b) is satisfied: (a) a downstream end of the first outer peripheral surface is disposed on an outer side of an upstream end of the first blade-facing surface in the radial direction of the hub; (b) an upstream end of the second outer peripheral surface is disposed on an outer side of a downstream end of the first blade-facing surface in the radial direction of the hub.

According to the above rotary machine (1), the hub-side end surface of the rotor blade is formed into a spherical shape, and the first blade-facing surface has the first spherical region. Thus, the clearance between the hub-side end surface of the variable blade and the blade-facing surface of the hub does not basically increase even when the variable blade is revolved toward the close side. Accordingly, it is possible to reduce clearance loss.

Furthermore, in a case where the above described rotary machine (1) satisfies the above condition (a), it is possible to form the first blade-facing surface so as to reduce the protruding amount outward in the radial direction of the hub with respect to the virtual extended surface extended downstream from the first outer peripheral surface, as compared to a case not satisfying the above condition (a). Furthermore, it is also possible to form the first blade-facing surface so as not to protrude outward in the radial direction of the hub with respect to the virtual extended surface. As described above, it is possible to form the first blade-facing surface so as not to impair the smooth flow of fluid along the first outer peripheral surface, and thereby it is possible to easily suppress generation of a secondary flow and suppress performance deterioration of the rotary machine.

Furthermore, in a case where the above described rotary machine (1) satisfies the above condition (b), it is possible to form the first blade-facing surface so as to reduce the protruding amount outward in the radial direction of the hub with respect to the virtual extended surface extended upstream from the second outer peripheral surface, as compared to a case not satisfying the above condition (b). Furthermore, it is possible to form the first blade-facing surface so as not to protrude outward in the radial direction of the hub with respect to the virtual extended surface. As described above, it is possible to form the first blade-facing surface so as to suppress separation at downstream of the spherical region, and thereby it is possible to suppress performance deterioration of the rotary machine.

Thus, with the above rotary machine (1), if at least one of the above condition (a) or (b) is satisfied, it is possible to suppress performance deterioration of the rotary machine.

(2) In some embodiments, in the rotary machine described in the above (1), the rotary machine satisfies at least the condition (a). The first blade-facing surface is formed so as not to protrude outward in the radial direction of the hub from a first virtual extended surface extended downstream from the first outer peripheral surface.

With the above rotary machine (2), it is possible to suppress obstruction of the smooth flow of a fluid along the first outer peripheral surface by the first blade-facing surface disposed downstream of the first outer peripheral surface, and thereby it is possible to easily suppress performance deterioration of the rotary machine.

(3) In some embodiments, in the rotary machine described in the above (1) or (2), the rotary machine satisfies at least the condition (b). The first blade-facing surface is formed so as not to protrude outward in the radial direction of the hub from a second virtual extended surface extended upstream from the second outer peripheral surface.

With the above rotary machine (3), it is possible to suppress separation downstream of the spherical region, and thereby it is possible to suppress performance deterioration of the rotary machine.

(4) In some embodiments, in the rotary machine described in any one of the above (1) to (3), a spherical center of the first spherical region is disposed on an intersection between the pivot axis of the variable blade and the rotational center axis of the rotary machine. Provided that R0 is a spherical radius of the first spherical region and R1 is a distance between the spherical center and a first virtual extended surface extended downstream from the first outer peripheral surface, the first spherical region is formed so as to satisfy an expression R0≤R1.

With the above rotary machine (4), it is possible to suppress obstruction of the smooth flow of a fluid along the first outer peripheral surface by the first blade-facing surface disposed downstream of the first outer peripheral surface, and thereby it is possible to easily suppress performance deterioration of the rotary machine.

(5) In some embodiments, in the rotary machine described in any one of the above (1) to (4), a spherical center of the first spherical region is disposed on an intersection between the pivot axis of the variable blade and the rotational center axis of the rotary machine. Provided that R0 is a spherical radius of the first spherical region and R2 is a distance between the spherical center and a second virtual extended surface extended upstream from the second outer peripheral surface, the first spherical region is formed so as to satisfy an expression R0≤R2.

With the above rotary machine (5), it is possible to suppress separation downstream of the spherical region, and thereby it is possible to suppress performance deterioration of the rotary machine.

(6) In some embodiments, in the rotary machine described in any one of the above (1) to (5), the pivot axis of the variable blade is disposed closer to a leading edge than a center of a chord line of the variable blade. A distance Dh1 between an upstream end of the first blade-facing surface and the rotational center axis of the rotary machine is greater than a distance Dh2 between a downstream end of the first blade-facing surface and the rotational center axis of the rotary machine. A distance L1 between the upstream end of the first blade-facing surface and the pivot axis of the variable blade is smaller than a distance L2 between the downstream end of the first blade-facing surface and the pivot axis of the variable blade.

With the above rotary machine (6), it is possible to reduce the axial-directional distance and the radial-directional distance between the upstream end of the first blade-facing surface including the first spherical region and the vertex of the first spherical region (the vertex is the farthest point from the hub center axis in the radial direction of the hub, which exists on the first spherical region, and is normally an intersection between the first spherical region and the pivot axis). Thus, it is possible to make the size of the rotary machine compact in the axial direction and to suppress the recirculation flow in the vicinity of the first blade-facing surface by reducing the unnecessary space on the side of the leading edge. Furthermore, it is possible to suppress the protruding amount of the first spherical region vertex in the radial direction from the first outer peripheral surface, and to reduce the influence of the first blade-facing surface on the smooth flow of a fluid along the first outer peripheral surface effectively.

(7) In some embodiments, in the rotary machine described in the above (6), a distance L3 in the axial direction of the hub between the downstream end of the first outer peripheral surface of the hub and the pivot axis of the variable blade is smaller than a distance L4 in the axial direction of the hub between the upstream end of the second outer peripheral surface of the hub and the pivot axis of the variable blade.

With the above rotary machine (7), it is possible to make the size of the rotary machine compact in the axial direction and to suppress the recirculation flow in the vicinity of the first blade-facing surface by reducing the unnecessary space on the side of the leading edge of the blade.

(8) In some embodiments, in the rotary machine described in any one of the above (1) to (7), the variable blade includes a tip-side end surface having a spherical shape and protruding outward in the radial direction of the hub. The casing includes: a blade-facing casing portion including a second blade-facing surface which faces the tip-side end surface of the variable blade and which has a second spherical region having a spherical shape and recessed outward in the radial direction of the hub; an upstream casing portion disposed upstream of the blade-facing casing portion in the axial direction of the hub and having a first inner peripheral surface being adjacent to the second blade-facing surface in the axial direction; and a downstream casing portion disposed downstream of the blade-facing casing portion in the axial direction and having a second inner peripheral surface adjacent to the second blade-facing surface in the axial direction. The pivot axis of the variable blade is disposed closer to a leading edge than a center of a chord line of the variable blade. A distance Dt1 between an upstream end of the second blade-facing surface and the rotational center axis of the rotary machine is greater than a distance Dt2 between a downstream end of the second blade-facing surface and the rotational center axis of the rotary machine. A distance L5 between the upstream end of the second blade-facing surface and the pivot axis of the variable blade is smaller than a distance L6 between the downstream end of the second blade-facing surface and the pivot axis of the variable blade.

With the above rotary machine (8), it is possible to reduce the axial-directional distance and the radial-directional distance between the upstream end of the second blade-facing surface including the second spherical region and the vertex of the second spherical region (the vertex is the farthest point from the hub center axis in the radial direction of the hub, which exists on the second spherical region, and is normally an intersection between the second spherical region and the pivot axis). Thus, it is possible to make the size of the rotary machine compact in the axial direction and to suppress the recirculation flow in the vicinity of the second blade-facing surface by reducing the unnecessary space on the side of the leading edge of the blade.

(9) In some embodiments, in the rotary machine described in the above (8), a distance L7 between a downstream end of the first inner peripheral surface of the casing and the pivot axis of the variable blade is smaller than a distance L8 in the axial direction of the hub between an upstream end of the second inner peripheral surface of the casing and the pivot axis of the variable blade.

With the above rotary machine (9), it is possible to make the size of the rotary machine compact in the axial direction and to suppress the recirculation flow in the vicinity of the second blade-facing surface by reducing the unnecessary space on the side of the leading edge of the blade.

(10) A rotary machine according to at least one embodiment of the present invention comprises: a hub configured to be rotatable about a rotational center axis; a casing configured to cover the hub and forming a fluid flow passage between the casing and the hub; and a variable blade disposed in the fluid flow passage and configured to be revolvable about a pivot axis along a radial direction of the hub. The variable blade includes a tip-side end surface having a spherical shape and protruding outward in the radial direction of the hub. The casing includes: a blade-facing casing portion including a second blade-facing surface which faces the tip-side end surface of the variable blade and which has a second spherical region having a spherical shape and recessed outward in the radial direction of the hub; an upstream casing portion disposed upstream of the blade-facing casing portion in the axial direction of the hub and having a first inner peripheral surface being adjacent to the second blade facing surface in the axial direction; and a downstream casing portion disposed downstream of the blade-facing casing portion in the axial direction and having a second inner peripheral surface being adjacent to the second blade-facing surface in the axial direction. The pivot axis of the variable blade is disposed closer to a leading edge than a center of a chord line of the variable blade. A distance DO between an upstream end of the second blade-facing surface and the rotational center axis of the rotary machine is greater than a distance Dt2 between a downstream end of the second blade-facing surface and the rotational center axis of the rotary machine. A distance L5 between the upstream end of the second blade-facing surface and the pivot axis of the variable blade is smaller than a distance L6 between the downstream end of the second blade-facing surface and the pivot axis of the variable blade.

With the above rotary machine (10), it is possible to reduce the axial-directional distance and the radial-directional distance between the upstream end of the second blade-facing surface including the second spherical region and the vertex of the second spherical region (the vertex is the farthest point from the rotational center axis in the radial direction of the hub, which exists on the second spherical region, and is normally an intersection between the second spherical region and the pivot axis). Thus, it is possible to make the size of the rotary machine compact in the axial direction and to suppress the recirculation flow in the vicinity of the second blade-facing surface by reducing the unnecessary space on the side of the leading edge of the blade.

(11) In some embodiments, in the rotary machine described in the above (10), a distance L7 between a downstream end of the first inner peripheral surface of the casing and the pivot axis of the variable blade is smaller than a distance L8 in the axial direction of the hub between an upstream end of the second inner peripheral surface of the casing and the pivot axis of the variable blade.

With the above rotary machine (11), it is possible to make the size of the rotary machine compact in the axial direction and to suppress the recirculation flow in the vicinity of the second blade-facing surface by reducing the unnecessary space on the side of the leading edge of the blade.

Advantageous Effects

According to at least one embodiment of the present invention, with a rotary machine provided with a variable blade configured to be revolvable about a pivot axis along the radial direction of a hub, it is possible to reduce clearance loss and suppress performance deterioration.

DETAILED DESCRIPTION

Embodiments of the present invention will now be described in detail with reference to the accompanying drawings. It is intended, however, that unless particularly specified, dimensions, materials, shapes, relative positions and the like of components described in the embodiments shall be interpreted as illustrative only and not intended to limit the scope of the present invention.

For instance, an expression of relative or absolute arrangement such as "in a direction", "along a direction", "parallel", "orthogonal", "centered", "concentric" and "coaxial" shall not be construed as indicating only the arrangement in a strict literal sense, but also includes a state where the arrangement is relatively displaced by a tolerance, or by an angle or a distance whereby it is possible to achieve the same function.

On the other hand, an expression such as "comprise", "include", "have", "contain" and "constitute" are not intended to be exclusive of other components.

Figure 1:
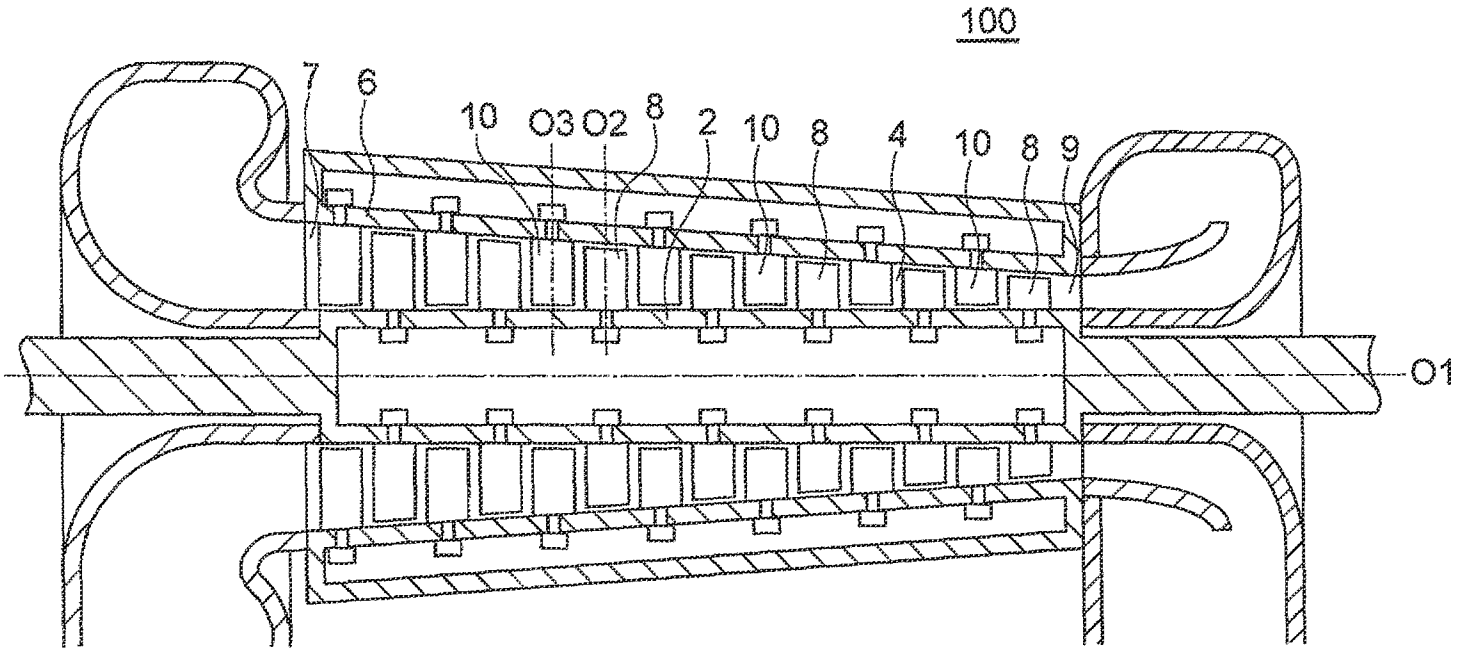
FIG. 1 is a cross-sectional view of a schematic configuration of an axial-flow compressor serving as a rotary machine according to an embodiment.

FIG. 1 is a cross-sectional view of a schematic configuration of an axial-flow compressor 100 serving as a rotary machine according to some embodiments.

The axial-flow compressor 100 shown in FIG. 1 includes a hub 2 configured to rotate about the rotational center axis O1, a casing 6 configured to cover the hub 2 and forming a fluid flow passage 4 with the hub 2, rotor blades 8 fixed to the hub 2, and stationary vanes 10 fixed to the casing 6.

The rotor blades 8 are disposed in the fluid flow passage 4, and configured to be revolvable about the pivot axis O2 along the radial direction of the hub 2. A plurality of rotor blades 8 are arranged in the circumferential direction at an axial-directional position on the rotational center axis O1, forming one rotor-blade row. A plurality of rotor-blade rows are arranged along the axial direction of the rotational center axis O1 (hereinafter, referred to as the axial direction of the hub 2).

The stationary vanes 10 are disposed in the fluid flow passage 4, and configured to be revolvable about the pivot axis O3 along the radial direction of the hub 2. A plurality of stationary vanes 10 are arranged in the circumferential direction at a position in the axial direction of the hub 2, forming one stationary-vane row. The rotor-blade rows and the stationary-vane rows are arranged alternately in the axial direction of the hub.

When the hub 2 and the rotor blades 8 fixed to the hub 2 rotate about the rotational center axis O1, a fluid that flows from an inlet 7 of the casing 6 becomes compressed, and the compressed fluid flows out from an outlet 9 of the casing 6.

Next, with regard to the axial-flow compressor 100 shown in FIG. 1, a rotor blade 8 and the meridional cross-sectional shape around the rotor blade 8 according to some embodiments will be described with reference to FIGS. 2 to 9.

Figure 2:
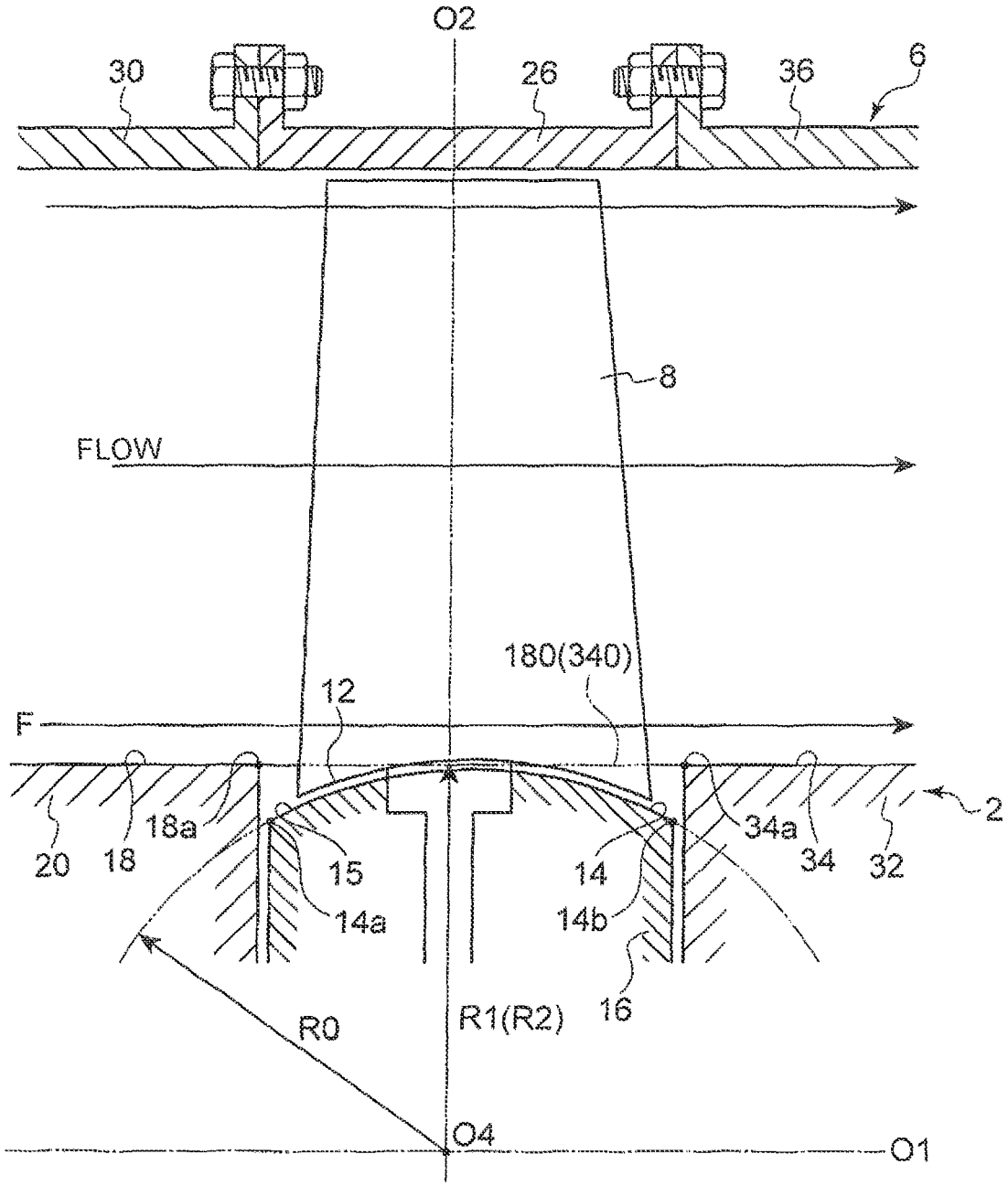
FIG. 2 is a schematic meridional cross-sectional view of a part of an axial-flow compressor according to an embodiment.
Figure 3:
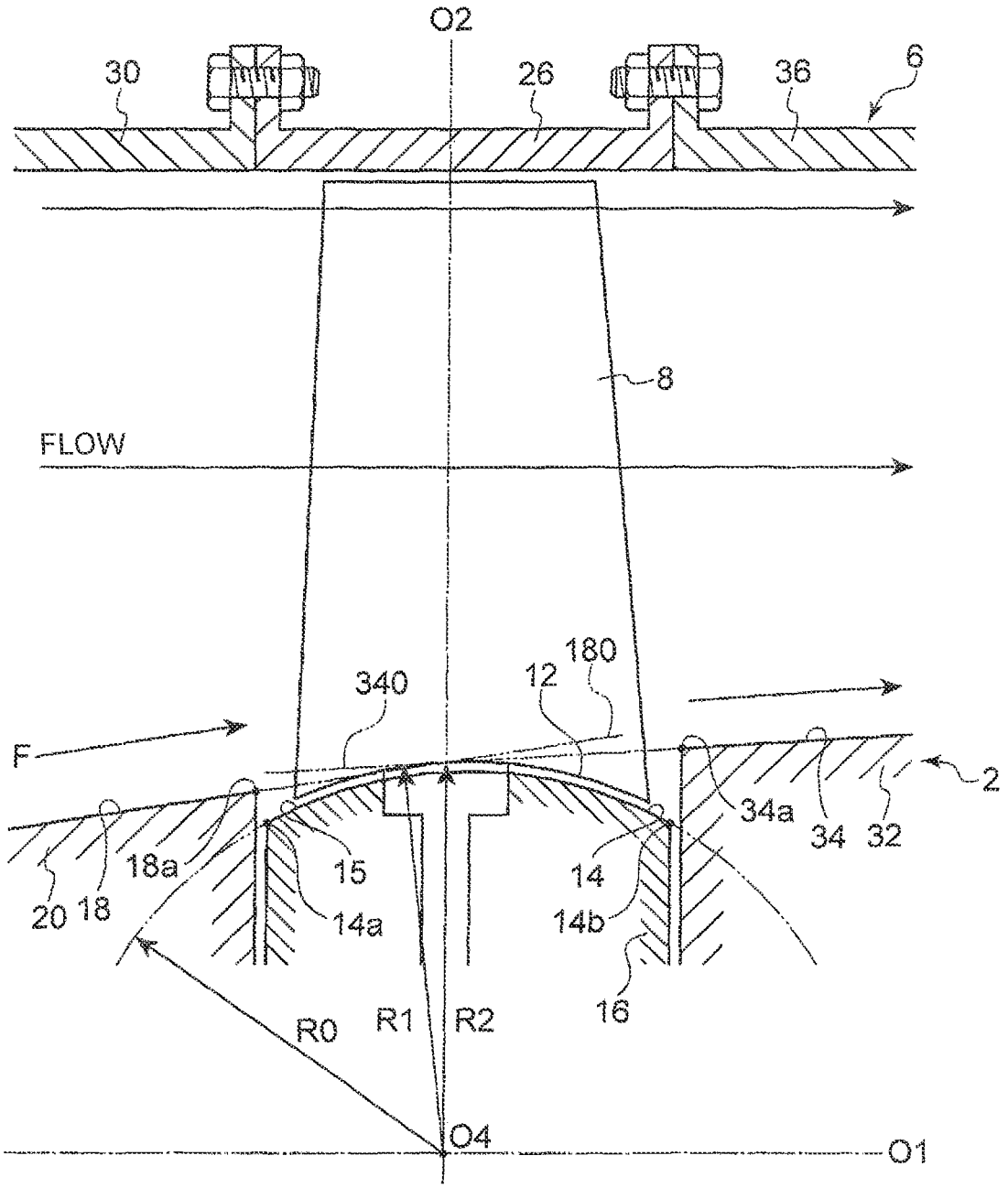
FIG. 3 is a schematic meridional cross-sectional view of a part of an axial-flow compressor according to an embodiment.
Figure 4:
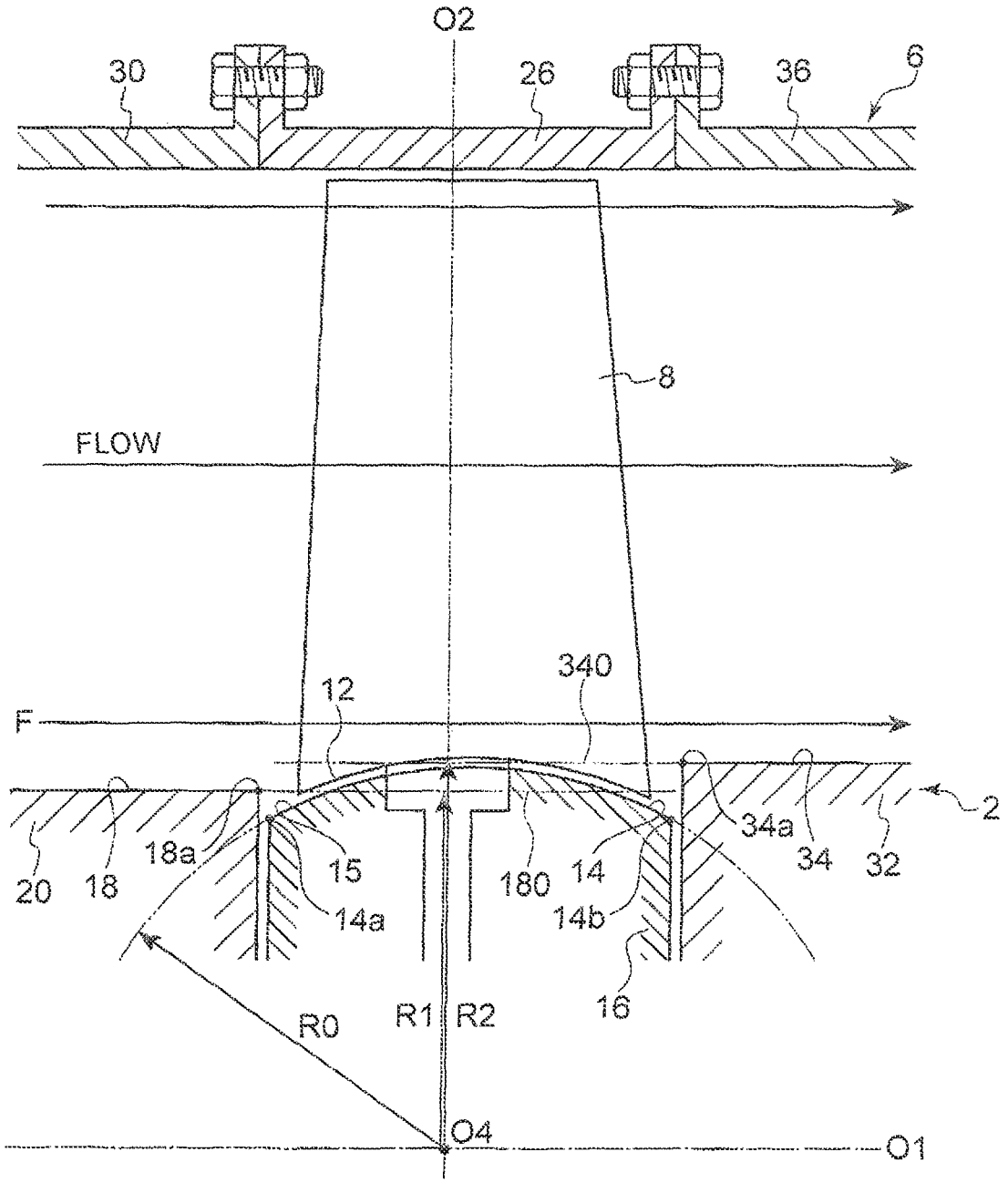
FIG. 4 is a schematic meridional cross-sectional view of a part of an axial-flow compressor according to an embodiment.
Figure 5:
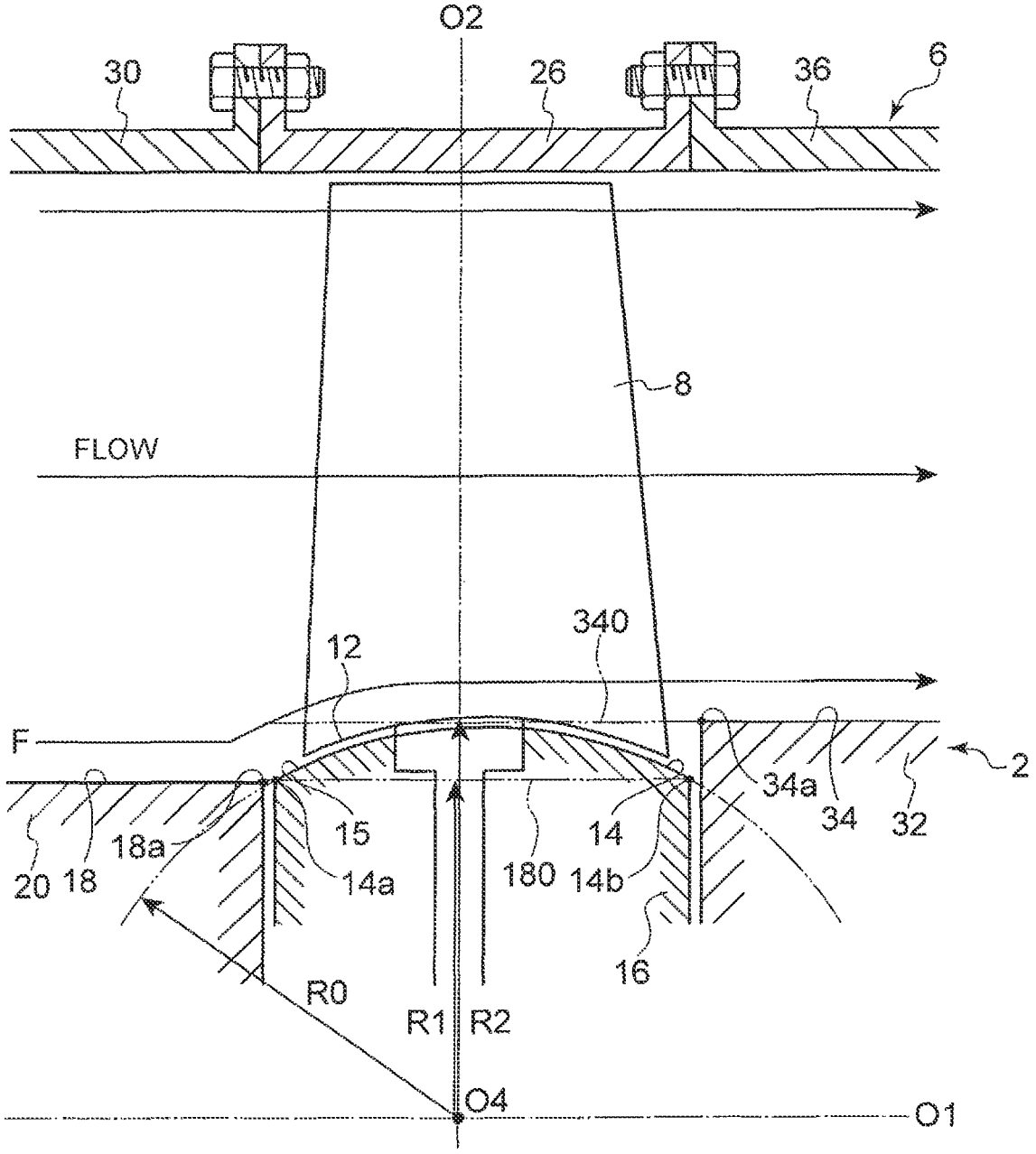
FIG. 5 is a schematic meridional cross-sectional view of a part of an axial-flow compressor according to an embodiment.
Figure 6:
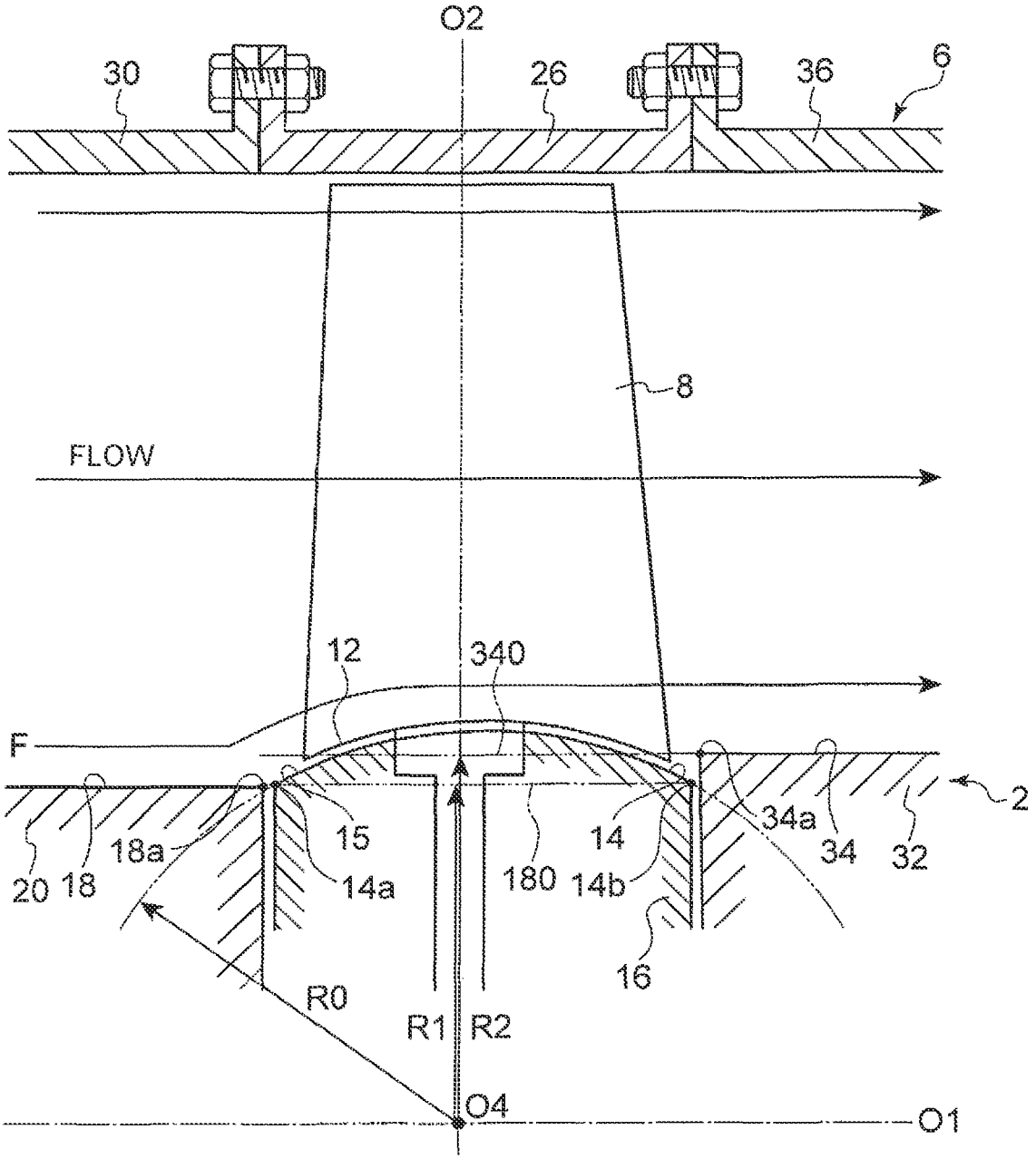
FIG. 6 is a schematic meridional cross-sectional view of a part of an axial-flow compressor according to an embodiment.
Figure 7:
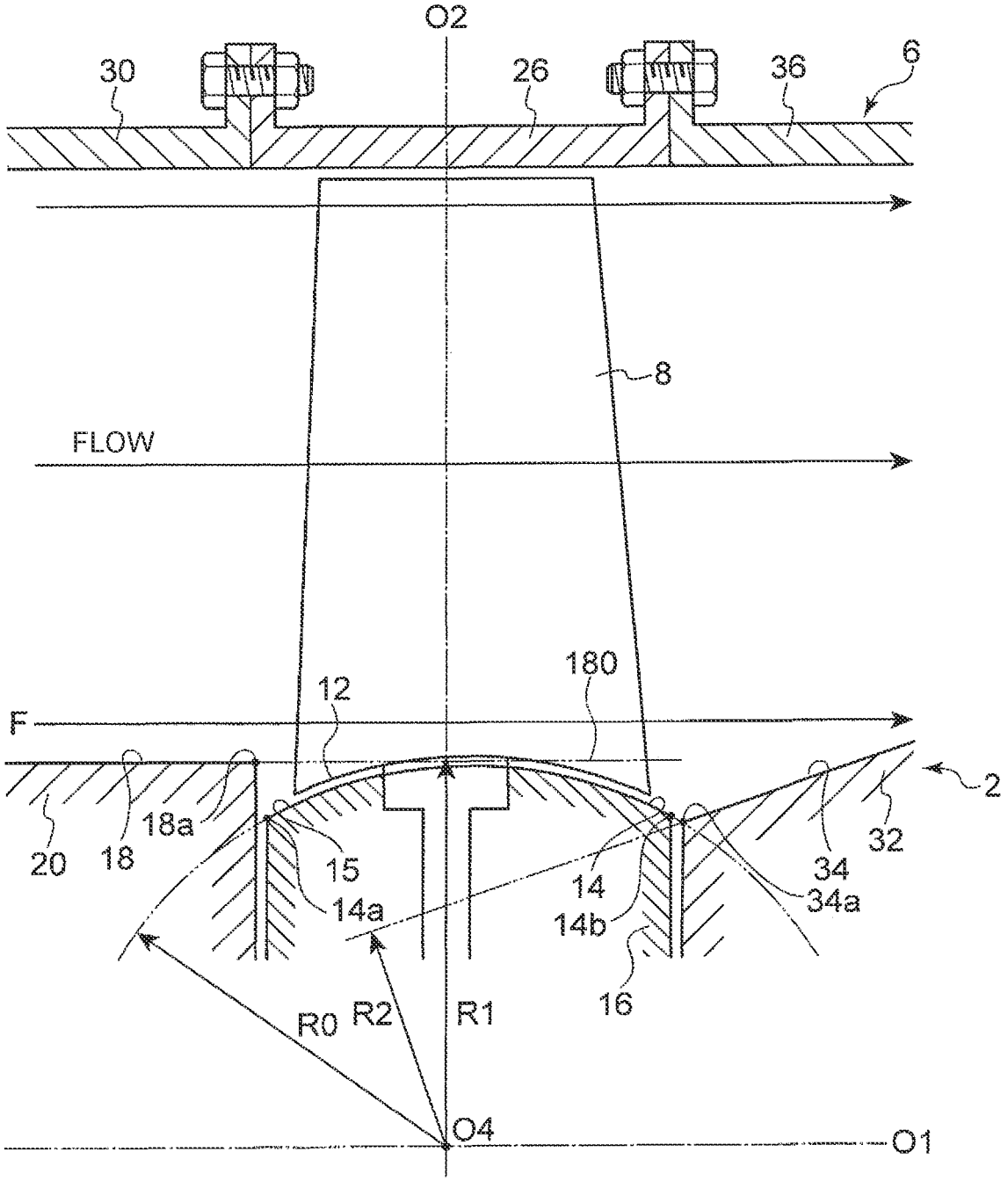
FIG. 7 is a schematic meridional cross-sectional view of a part of an axial-flow compressor according to an embodiment.
Figure 8:
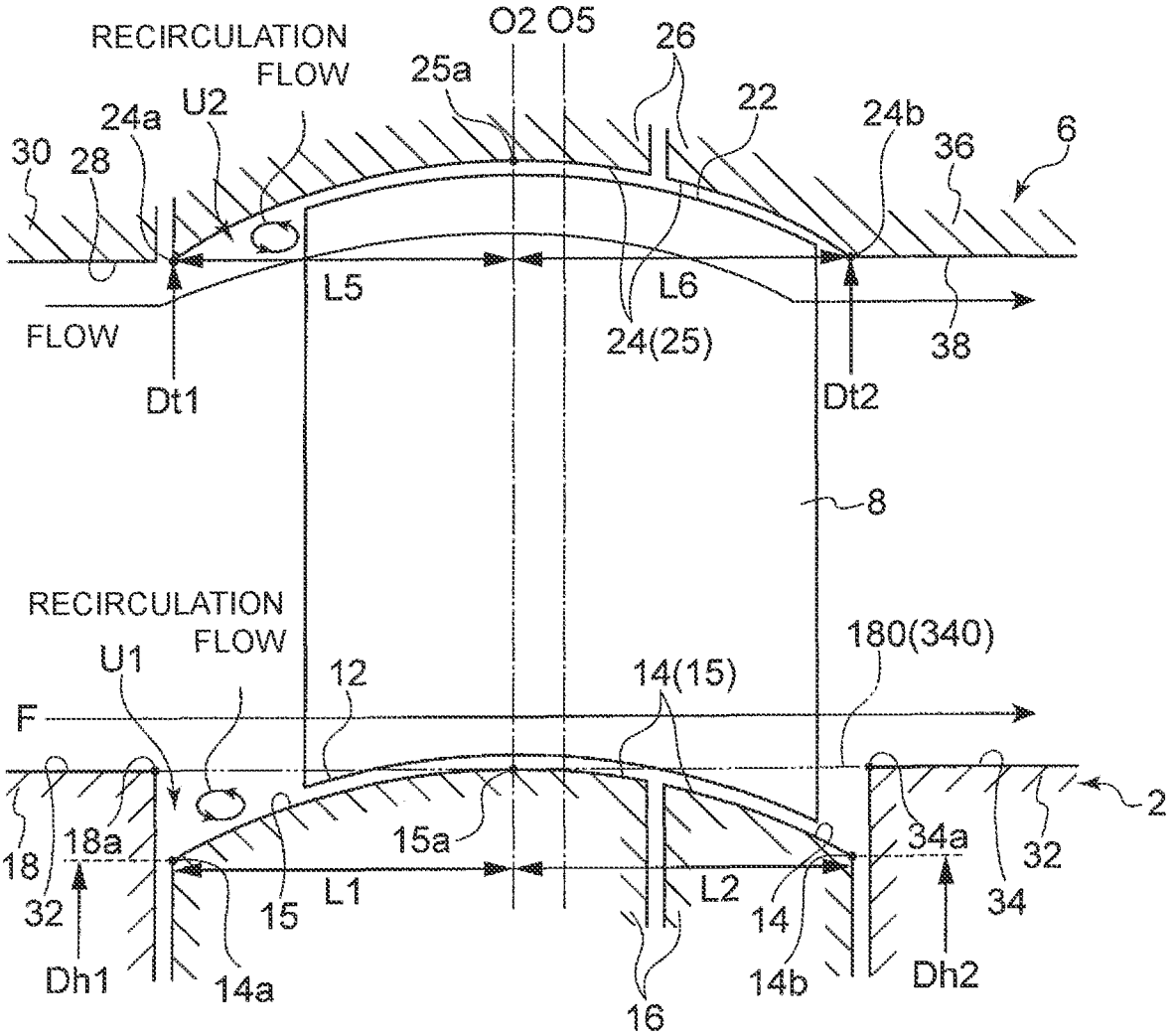
FIG. 8 is a schematic meridional cross-sectional view of a part of an axial-flow compressor according to an embodiment.
Figure 9:
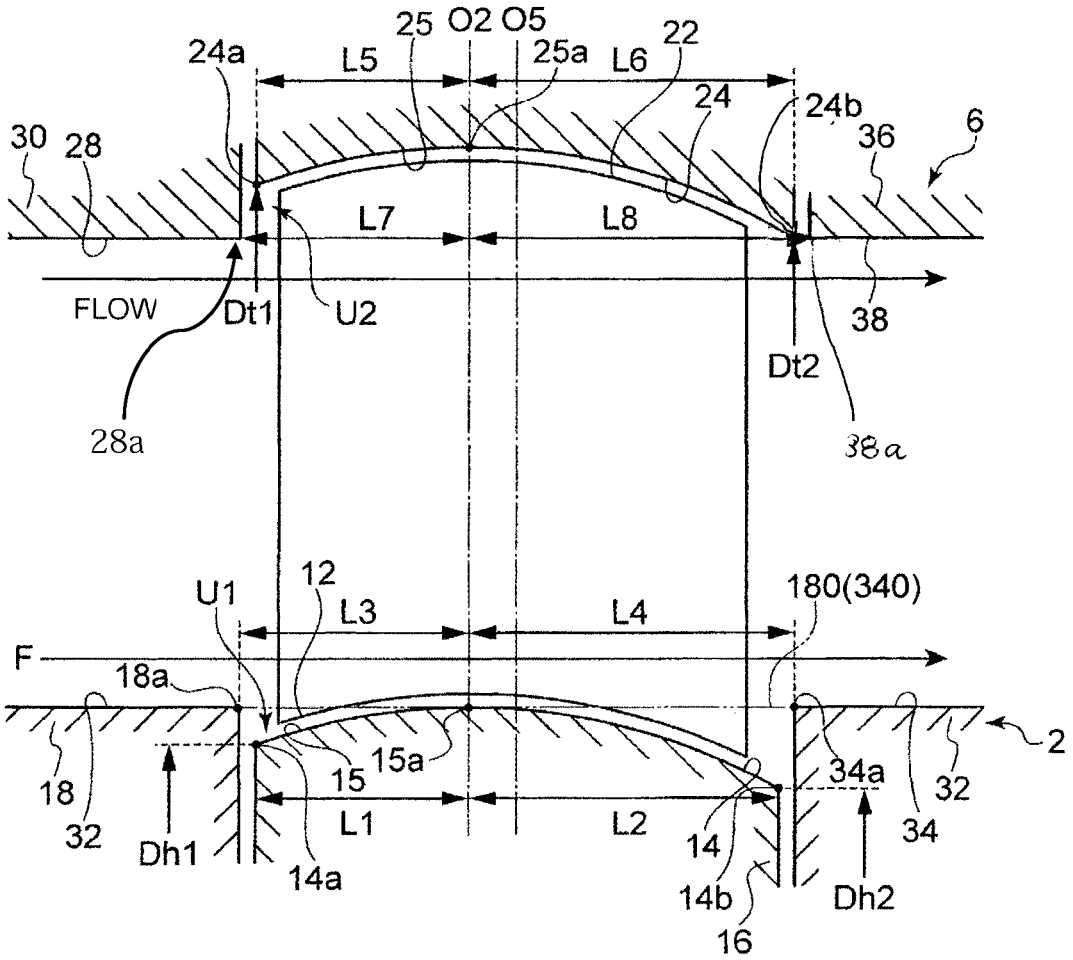
FIG. 9 is a schematic meridional cross-sectional view of a part of an axial-flow compressor according to an embodiment.

FIG. 2 is a schematic meridional cross-sectional view of a part of an axial-flow compressor 100 according to an embodiment. FIG. 3 is a schematic meridional cross-sectional view of a part of an axial-flow compressor 100 according to an embodiment. FIG. 4 is a schematic meridional cross-sectional view of a part of an axial-flow compressor 100 according to an embodiment. FIG. 5 is a schematic meridional cross-sectional view of a part of an axial-flow compressor 100 according to an embodiment. FIG. 6 is a schematic meridional cross-sectional view of a part of an axial-flow compressor 100 according to an embodiment. FIG. 7 is a schematic meridional cross-sectional view of a part of an axial-flow compressor 100 according to an embodiment. FIG. 8 is a schematic meridional cross-sectional view of a part of an axial-flow compressor 100 according to an embodiment. FIG. 9 is a schematic meridional cross-sectional view of a part of an axial-flow compressor 100 according to an embodiment.

In some embodiments, as shown in FIGS. 2 to 9 for instance, the rotor blade 8 includes a hub-side end surface 12 having a spherical shape and recessed outward in the radial direction of the hub 2. The hub 2 includes a blade-facing hub portion 16 facing the hub-side end surface 12 of the rotor blade 8, an upstream hub portion 20 disposed upstream of the blade-facing hub portion 16 in the axial direction of the hub 2, and a downstream hub portion 32 disposed downstream of the blade-facing hub portion 16 in the axial direction of the hub 2. The blade-facing hub portion 16 includes the first blade-facing surface 14 which faces the hub-side end surface 12 of the rotor blade 8 and which has the first spherical region 15 having a spherical shape and protruding outward in the radial direction of the hub 2. The upstream hub portion 20 has the first outer peripheral surface 18 adjacent to the first blade-facing surface 14 in the axial direction of the hub 2. The downstream hub portion 32 has the second outer peripheral surface 34 adjacent to the first blade-facing surface 14 in the axial direction of the hub 2. The spherical center O4 of the first spherical region 15 is disposed on the intersection of the pivot axis O2 of the rotor blade 8 and the rotational center axis O1 of the rotary machine. Furthermore, the upstream hub portion 20, the blade-facing hub portion 16, and the downstream hub portion 32 may be formed integrally (of one piece), or may be formed separately (of separate members). Alternatively, at least one of the upstream hub portion 20, the blade-facing hub portion 16, or the downstream hub portion 32 may be formed of a plurality of members. For instance, as shown in FIG. 8, the blade-facing hub portion 16 may be formed of a plurality of members.

According to the axial-flow compressor 100 shown in FIGS. 2 to 9, the hub-side end surface 12 of the rotor blade 8 is formed into a spherical shape, and the first blade-facing surface 14 has the first spherical region 15. Thus, the clearance between the hub-side end surface 12 of the rotor blade 8 and the first blade-facing surface 14 of the hub 2 does not basically increase even when the rotor blade 8 is revolved toward the close side. Accordingly, it is possible to reduce clearance loss.

In some embodiments, as shown in FIGS. 2 to 4 and 7 to 9 for instance, the downstream end 18*a* of the first outer peripheral surface 18 is disposed on the outer side of the upstream end 14*a* of the first blade-facing surface 14 in the radial direction of the hub 2.

In this case, as shown in FIGS. 2, 3, and 7 to 9 for instance, it is possible to form the first blade-facing surface 14 so as not to protrude outward in the radial direction of the hub 2 from the first virtual extended surface 180 extended downstream from the first outer peripheral surface 18. In the embodiment shown in FIGS. 2, 3, and 7 to 9, provided that R0 is the spherical radius of the first spherical region 15 and R1 is the distance between the first virtual extended surface 180 and the spherical center O4, the first spherical region 15 is formed so as to satisfy a relationship $R0 \leq R1$. Furthermore, as shown in FIG. 4, it is possible to reduce the protruding amount of the first blade-facing surface 14 of the hub 2 outward in the radial direction with respect to the virtual extended surface 180, even if the first blade-facing surface 14 is protruding outward in the radial direction of the hub 2 with respect to the first virtual extended surface 180 extended downstream from the first outer peripheral surface 18 (even if the first spherical region 15 is formed to satisfy $R0 > R1$).

Thus, it is possible to suppress obstruction of the smooth flow F of a fluid along the first outer peripheral surface 18 by the first blade-facing surface 14 disposed downstream of the first outer peripheral surface 18, and thereby it is possible to easily suppress generation of a secondary flow and to suppress performance deterioration of the axial-flow compressor 100.

Figure 10:
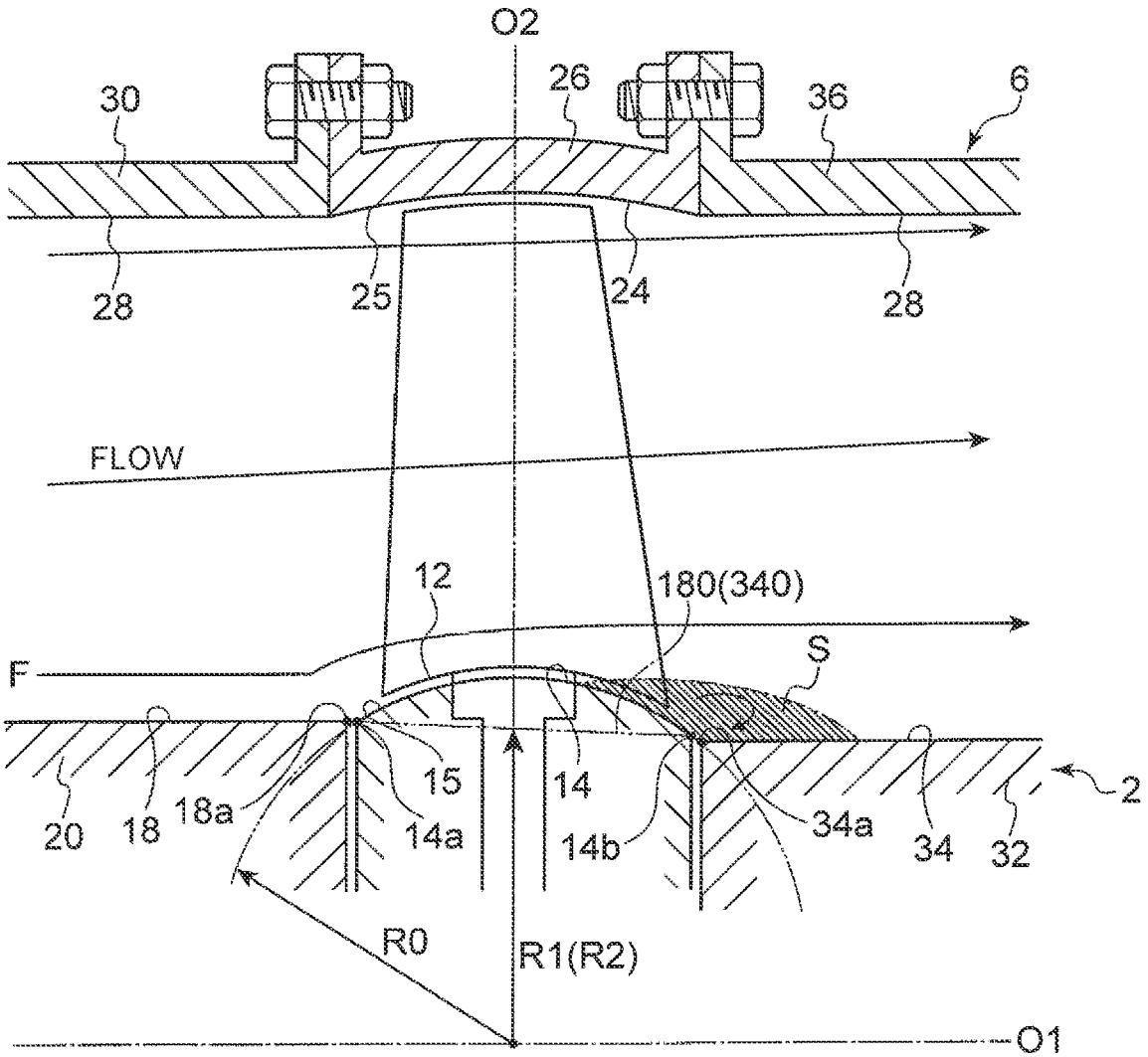
FIG. 10 is a schematic meridional cross-sectional view of a part of an axial-flow compressor according to a comparative example.

In contrast, as shown in FIG. 10, if the downstream end 18*a* of the first outer peripheral surface 18 is not positioned on the outer side of the upstream end 14*a* of the first blade-facing surface 14 in the radial direction of the hub 2 (if a step is not formed between the first blade-facing surface 14 and the outer peripheral surface 18), the first spherical region 15 obstructs the smooth fluid flow F along the first outer peripheral surface 18 of the hub 2. As a result, an outward flow in the radial direction of the hub 2 (secondary flow) is created, which may lead to deterioration of the performance of the axial-flow compressor.

In some embodiments, as shown in FIGS. 2 to 6, 8 and 9 for instance, the upstream end 34*a* of the second outer peripheral surface 34 is disposed on the outer side of the downstream end 14*b* of the first blade-facing surface 14 in the radial direction of the hub 2.

In this case, as shown in FIGS. 2 to 5, 8, and 9 for instance, it is possible to form the first blade-facing surface 14 so as not to protrude outward in the radial direction of the hub 2 with respect to the second virtual extended surface 340 extended upstream from the second outer peripheral surface 34. In the embodiment shown in FIGS. 2 to 5, 8, and 9, provided that R0 is the spherical surface radius of the first spherical region 15 and R2 is the distance between the second virtual extended surface 340 and the spherical center, the first spherical region 15 is formed so as to satisfy a relationship R0≤R2. Furthermore, as shown in FIG. 6, it is possible to reduce the protruding amount of the first blade-facing surface 14 outward in the radial direction of the hub 2 with respect to the second virtual extended surface 340, even if the first blade-facing surface 14 is protruding outward in the radial direction of the hub 2 with respect to the second virtual extended surface 340 extended upstream from the second outer peripheral surface 34.

Thus, according to the embodiments shown in FIGS. 2 to 6, 8, and 9, it is possible to suppress separation in the downstream region of the first spherical region 15, and to suppress deterioration of performance of the axial-flow compressor 100.

In contrast, as shown in FIG. 10, if the upstream end 34*a* of the second outer peripheral surface 34 is not positioned on the outer side of the downstream end 14*b* of the first blade-facing surface 14 in the radial direction of the hub 2 (if a step is not formed between the first blade-facing surface 14 and the second outer peripheral surface 34), separation may occur in the downstream region S of the first spherical region 15 and cause deterioration of performance of the axial-flow compressor.

In some embodiments, as shown in FIGS. 2, 8, and 9 for instance, the first outer peripheral surface 18 and the second outer peripheral surface 34 may be formed so that the first virtual extended surface 180 and the second virtual extended surface 340 coincide with each other. Alternatively, as shown in FIGS. 3 to 7 for instance, the first virtual extended surface 180 and the second virtual extended surface 340 may be offset from each other. In the latter case, to reduce the influence of the first blade-facing surface 14 on the smooth main-stream flow, it is desirable to form the first blade-facing surface 14 so as not to protrude outward in the radial direction of the hub 2 with respect to both of the first virtual extended surface 180 and the second virtual extended surface 340, as shown in FIG. 3. In the embodiment shown in FIG. 3, the first spherical region 15 is formed so as to satisfy both R0≤R1 and R0≤R2.

Compared to a case where R0>R1 and R0≤R2 are satisfied as shown in FIG. 5, separation can be more easily suppressed in the downstream region of the first spherical region 15 in a case where R0≤R1 and R0>R2 are satisfied as shown in FIG. 7. Thus, to suppress separation in the downstream region of the first spherical region 15, it is desirable to set the spherical radius R0 of the first spherical region 15 taking account of the second virtual extended surface 340 in priority to the first virtual extended surface 180.

In some embodiments, as shown in FIG. 8, the pivot axis O2 of the rotor blade 8 is disposed closer to the leading edge 40 than the center O5 of the chord line of the rotor blade 8. In the embodiment shown in FIG. 8, the distance Dh1 between the upstream end 14*a* of the first blade-facing surface 14 and the rotational center axis O1 of the axial-flow compressor 100 is equal to the distance Dh2 between the downstream end 14*b* of the first blade-facing surface 14 and the rotational center axis O1 of the axial-flow compressor 100. Further, the distance L1 between the upstream end 14*a* of the first blade-facing surface 14 and the pivot axis O2 of the rotor blade 8 is equal to the distance L2 between the downstream end 14*b* of the first blade-facing surface 14 and the pivot axis O2 of the rotor blade 8. Such a symmetric shape is usually adopted in a case where a spherical region is to be formed on the first blade-facing surface 14 of the hub 2. However, in this case, an unnecessary space U1 is created on the side of the leading edge 40 of the rotor blade 8, and a recirculation flow is formed in the vicinity of the first blade-facing surface 14. Thus, the efficiency of the axial-flow compressor 100 may decrease.

In contrast, in the embodiment shown in FIG. 9, the pivot axis O2 of the rotor blade 8 is disposed closer to the leading edge 40 than the center O5 of the chord line of the rotor blade 8. Further, the distance Dh1 between the upstream end 14*a* of the first blade-facing surface 14 and the rotational center axis O1 of the axial-flow compressor 100 is greater than the distance Dh2 between the downstream end 14*b* of the first blade-facing surface 14 and the rotational center axis O1 of the axial-flow compressor 100. Further, the distance L1 between the upstream end 14*a* of the first blade-facing surface 14 and the pivot axis O2 of the rotor blade 8 is smaller than the distance L2 between the downstream end 14*b* of the first blade-facing surface 14 and the pivot axis O2 of the rotor blade 8.

With this configuration, it is possible to reduce the axial-directional distance and the radial-directional distance between the upstream end 14*a* of the first blade-facing surface 14 including the first spherical region 15 and the vertex 15*a* of the first spherical region 15 (the vertex 15*a* is the farthest point from the rotational center axis O1 in the radial direction of the hub 2, which exists on the first spherical region 15, and is normally an intersection between the first spherical region 15 and the pivot axis O2). Thus, it is possible to make the size of the axial-flow compressor 100 compact in the axial direction and to suppress the recirculation flow (see FIG. 8) in the vicinity of the first blade-facing surface 14 by reducing the unnecessary space U1 on the side of the leading edge 40 of the rotor blade 8. Furthermore, it is possible to suppress the protruding amount of the first spherical region vertex 15*a* in the radial direction of the hub 2 from the first outer peripheral surface 18, and to reduce the influence of the first blade-facing surface 14 on the smooth flow F of a fluid along the first outer peripheral surface 18 effectively.

In some embodiments, as shown in FIG. 9 for instance, the distance L3 between the downstream end 18*a* of the first outer peripheral surface 18 of the hub 2 and the pivot axis O2 of the rotor blade 8 in the axial direction of the hub 2 is smaller than the distance L4 between the upstream end 34*a* of the second outer peripheral surface 34 of the hub 2 and the pivot axis O2 of the rotor blade 8 in the axial direction of the hub 2.

With this configuration, it is possible to make the size of the axial-flow compressor 100 compact in the axial direction and to suppress the recirculation flow (see FIG. 8) in the vicinity of the first blade-facing surface 14 by reducing the unnecessary space U1 on the side of the leading edge 40 of the rotor blade 8. Furthermore, the fluid flowing through the fluid flow passage 4 is less likely to enter the clearance between the hub-side end surface 12 of the rotor blade 8 and the first blade-facing surface 14 of the hub 2 through the space U1. Accordingly, it is possible to suppress a decrease in the efficiency of the axial-flow compressor 100.

In some embodiments, as shown in FIGS. 8 and 9 for instance, the rotor blade 8 includes a tip-side end surface 22 having a spherical shape and protruding outward in the radial direction of the hub 2. The casing 6 includes a blade-facing casing portion 26 facing the tip-side end surface 22 of the rotor blade 8, an upstream casing portion 30 disposed upstream of the blade-facing casing portion 26 in the axial direction of the hub 2, and a downstream casing portion 36 disposed downstream of the blade-facing casing portion 26 in the axial direction of the hub 2. The blade-facing casing portion 26 includes the second blade-facing surface 24 which faces the tip-side end surface 22 of the rotor blade 8 and which has the second spherical region 25 having a spherical shape and recessed outward in the radial direction of the hub 2. The upstream casing portion 30 has the first inner peripheral surface 28 adjacent to the second blade-facing surface 24 in the axial direction of the hub 2. The downstream casing portion 36 has the second inner peripheral surface 38 adjacent to the second blade-facing surface 24 in the axial direction of the hub 2. Furthermore, the upstream casing portion 30, the blade-facing casing portion 26, and the downstream casing portion 36 may be formed integrally (of one piece), or may be formed separately (of separate members). Alternatively, at least one of the upstream casing portion 30, the blade-facing casing portion 26, or the downstream casing portion 36 may be formed of a plurality of members. For instance, as shown in FIG. 8, the blade-facing casing portion 26 may be formed of a plurality of members.

According to the axial-flow compressor 100 shown in FIGS. 8 and 9, the tip-side end surface 22 of the rotor blade 8 is formed into a spherical shape, and the second blade-facing surface 24 has the second spherical region 25. Thus, the clearance between the tip-side end surface 22 of the rotor blade 8 and the second blade-facing surface 24 of the casing 6 does not basically increase even when the rotor blade 8 is revolved toward the open side (in a direction that the angle between the chord line of the rotor blade 8 and the axial direction of the hub 2 decreases). Accordingly, it is possible to reduce clearance loss.

In some embodiments, as shown in FIG. 8 for instance, the pivot axis O2 of the rotor blade 8 is disposed closer to the leading edge 40 than the center O5 of the chord line of the rotor blade 8. Further, the distance DO between the upstream end 24*a* of the second blade-facing surface 24 and the rotational center axis O1 of the axial-flow compressor 100 is equal to the distance Dt2 between the downstream end 24*b* of the second blade-facing surface 24 and the rotational center axis O1 of the axial-flow compressor 100. Further, the distance L5 between the upstream end 24*a* of the second blade-facing surface 24 and the pivot axis O2 of the rotor blade 8 is equal to the distance L6 between the downstream end 24*b* of the second blade-facing surface 24 and the pivot axis O2 of the rotor blade 8. Such a symmetric shape is usually adopted in a case where a spherical region is to be formed on the second blade-facing surface 24 of the hub 2. However, in this case, an unnecessary space U2 is created on the side of the leading edge 40 of the rotor blade 8, and a recirculation flow is generated in the vicinity of the first blade-facing surface 14. Thus, the efficiency of the axial-flow compressor 100 may decrease.

In contrast, in the embodiment shown in FIG. 9, the pivot axis O2 of the rotor blade 8 is disposed closer to the leading edge 40 than the center O5 of the chord line of the rotor blade 8. Further, the distance DO between the upstream end 24*a* of the second blade-facing surface 24 and the rotational center axis O1 of the axial-flow compressor 100 is greater than the distance Dt2 between the downstream end 24*b* of the second blade-facing surface 24 and the rotational center axis O1 of the axial-flow compressor 100. Further, the distance L5 between the upstream end 24*a* of the second blade-facing surface 24 and the pivot axis O2 of the rotor blade 8 is smaller than the distance L6 between the downstream end 24*b* of the second blade-facing surface 24 and the pivot axis O2 of the rotor blade 8.

With this configuration, it is possible to reduce the axial-directional distance and the radial-directional distance between the upstream end 24*a* of the second blade-facing surface 24 including the second spherical region 25 and the vertex 25*a* of the second spherical region 25 (the vertex 25*a* is the farthest point from the rotational center axis O1 in the radial direction of the hub 2, which exists on the second spherical region 25, and is normally an intersection between the second spherical region 25 and the pivot axis O2). Thus, it is possible to make the size of the axial-flow compressor 100 compact in the axial direction and to suppress the recirculation flow (see FIG. 8) in the vicinity of the second blade-facing surface 24 by reducing the unnecessary space U2 on the side of the leading edge 40 of the rotor blade 8.

In some embodiments, as shown in FIG. 9 for instance, the distance L7 between the downstream end 28*a* of the first inner peripheral surface 28 of the casing 6 and the pivot axis O2 of the rotor blade 8 is smaller than the distance L8 between the upstream end 38*a* of the second inner peripheral surface 38 of the casing and the pivot axis O2 of the rotor blade 8 in the axial direction of the hub 2.

With this configuration, it is possible to make the size of the axial-flow compressor 100 compact in the axial direction and to suppress the recirculation flow (see FIG. 8) in the vicinity of the second blade-facing surface 24 by reducing the unnecessary space U2 on the side of the leading edge 40 of the rotor blade 8. Furthermore, a fluid flowing into the space U2 from the main-stream section of the fluid flow passage 4 decreases, and thereby it is possible to suppress a leakage flow through the clearance between the tip-side end surface 22 of the rotor blade 8 and the second blade-facing surface 24 of the casing 6. Accordingly, it is possible to suppress a decrease in the efficiency of the axial-flow compressor 100.

Embodiments of the present invention were described in detail above, but the present invention is not limited thereto, and various amendments and modifications may be implemented.

For instance, while the relationship between the shape of the rotor blade 8 and the shape of the fluid flow passage 4 formed by the hub 2 and the casing 6 is described in the above embodiments, this relationship can be applied to the relationship between the shape of the fluid flow passage 4 and the shape of the stationary vane 10.

Furthermore, the present invention can be applied to a rotary machine such as a boiler axial-flow fan, a blast-furnace axial-flow blower, a gas turbine compressor, and various turbines.

DESCRIPTION OF REFERENCE NUMERALS

1 Hub
4 Fluid flow passage
6 Casing
7 Inlet
8 Rotor blade
9 Outlet

10 Stationary vane
12 Hub-side end surface
14 First blade-facing surface
14*a* Upstream end of first blade-facing surface
15 First spherical region
16 Blade-facing hub portion
16 blade-facing casing portion
18 First outer peripheral surface
18*a* Downstream end of first outer peripheral surface
20 Upstream hub portion
22 Tip-side end surface
24 Second blade-facing surface
24*a* Upstream end of second blade-facing surface
25 Second spherical region
26 Blade-facing casing portion
28 First inner peripheral surface
28*a* Downstream end of inner peripheral surface
30 Upstream casing portion
32 Downstream hub portion
34 Second outer peripheral surface
34*a* Upstream end of second outer peripheral surface
36 Downstream casing portion
38 Second inner peripheral surface
38*a* Upstream end of inner peripheral surface
40 Leading edge
100 Axial-flow compressor
180 First virtual extended surface
340 Second virtual extended surface

The invention claimed is:

1. A rotary machine comprising:

a hub configured to be rotatable about a rotational center axis;

a casing configured to cover the hub and forming a fluid flow passage between the casing and the hub; and a variable blade disposed in the fluid flow passage and configured to be revolvable about a pivot axis along a radial direction of the hub, wherein the variable blade includes a hub-side end surface having a spherical shape and recessed outward in the radial direction of the hub, wherein the hub includes:

a blade-facing hub portion including a first blade-facing surface which faces the hub-side end surface of the variable blade and which has a first spherical region having a spherical shape and protruding outward in the radial direction of the hub;

an upstream hub portion disposed upstream of the blade-facing hub portion in an axial direction of the hub and having a first outer-peripheral surface being adjacent to the first blade-facing surface in the axial direction; and a downstream hub portion disposed downstream of the blade-facing hub portion in the axial direction and having a second outer peripheral surface being adjacent to the first blade-facing surface in the axial direction, and wherein at least one of following condition (a) or (b) is satisfied:

(a) a downstream end of the first outer peripheral surface is disposed on an outer side of an upstream end of the first blade-facing surface in the radial direction of the hub;

(b) an upstream end of the second outer peripheral surface is disposed on an outer side of a downstream end of the first blade-facing surface in the radial direction of the hub, and wherein a spherical center of the first spherical region is disposed on an intersection between the pivot axis of the variable blade and the rotational center axis of the rotary machine.

2. The rotary machine according to claim 1, wherein the rotary machine satisfies at least the condition (a), and wherein the first blade-facing surface is formed so as not to protrude outward in the radial direction of the hub from a first virtual extended surface extended downstream from the first outer peripheral surface.

3. The rotary machine according to claim 1, wherein the rotary machine satisfies at least the condition (b), and wherein the first blade-facing surface is formed so as not to protrude outward in the radial direction of the hub from a second virtual extended surface extended upstream from the second outer peripheral surface.

4. The rotary machine according to claim 1, wherein, provided that R0 is a spherical radius of the first spherical region and R1 is a distance between the spherical center and a first virtual extended surface extended downstream from the first outer peripheral surface, the first spherical region is formed so as to satisfy an expression $R0 \leq R1$.

5. The rotary machine according to claim 1, wherein, provided that R0 is a spherical radius of the first spherical region and R2 is a distance between the spherical center and a second virtual extended surface extended upstream from the second outer peripheral surface, the first spherical region is formed so as to satisfy an expression $R0 \leq R2$.

6. The rotary machine according to claim 1, wherein a distance from the pivot axis of the variable blade to a leading edge is shorter than a distance from a center of a chord line of the variable blade to the leading edge, wherein a distance Dh1 between an upstream end of the first blade-facing surface and the rotational center axis of the rotary machine is greater than a distance Dh2 between a downstream end of the first blade-facing surface and the rotational center axis of the rotary machine, and wherein a distance L1 between the upstream end of the first blade-facing surface and the pivot axis of the variable blade is smaller than a distance L2 between the downstream end of the first blade-facing surface and the pivot axis of the variable blade.

7. The rotary machine according to claim 6, wherein a distance L3 in the axial direction of the hub between the downstream end of the first outer peripheral surface of the hub and the pivot axis of the variable blade is smaller than a distance L4 in the axial direction of the hub between the upstream end of the second outer peripheral surface of the hub and the pivot axis of the variable blade.

8. The rotary machine according to claim 1, wherein the variable blade includes a tip-side end surface having a spherical shape and protruding outward in the radial direction of the hub, wherein the casing includes:

a blade-facing casing portion including a second blade-facing surface which faces the tip-side end surface of the variable blade and which has a second spherical region having a spherical shape and recessed outward in the radial direction of the hub;

an upstream casing portion disposed upstream of the blade-facing casing portion in the axial direction of the hub and having a first inner peripheral surface being adjacent to the second blade-facing surface in the axial direction; and a downstream casing portion disposed downstream of the blade-facing casing portion in the axial direction and having a second inner peripheral surface adjacent to the second blade-facing surface in the axial direction, wherein a distance from the pivot axis of the variable blade to a leading edge is shorter than a distance from a center of a chord line of the variable blade to the leading edge, wherein a distance Dt1 between an upstream end of the second blade-facing surface and the rotational center axis of the rotary machine is greater than a distance Dt2 between a downstream end of the second blade-facing surface and the rotational center axis of the rotary machine, and the distance Dt1 is greater than a distance between the first inner peripheral surface and the rotational center axis of the rotary machine, and wherein a distance L5 between the upstream end of the second blade-facing surface and the pivot axis of the variable blade is smaller than a distance L6 between the downstream end of the second blade-facing surface and the pivot axis of the variable blade.

9. The rotary machine according to claim 8, wherein a distance L7 between a downstream end of the first inner peripheral surface of the casing and the pivot axis of the variable blade is smaller than a distance L8 in the axial direction of the hub between an upstream end of the second inner peripheral surface of the casing and the pivot axis of the variable blade.

* * * * *